US005736717A

United States Patent [19]

Lee et al.

[11] Patent Number: 5,736,717

[45] Date of Patent: Apr. 7, 1998

[54] MICROWAVE OVEN WITH VAPOR SENSOR AND AUDIBLE COOKING STATE INDICATOR

[75] Inventors: Seung Koo Lee; Hyong Tack Lim, both of Seoul, Rep. of Korea

[73] Assignee: LG Electronics Inc., Seoul, Rep. of Korea

[21] Appl. No.: 739,601

[22] Filed: Oct. 30, 1996

[30] Foreign Application Priority Data

Oct. 30, 1995 [KR] Rep. of Korea ..... 1995-38247

[51] Int. Cl.[6] ..... H05B 6/68

[52] U.S. Cl. ..... 219/720; 219/707; 219/506; 99/325

[58] Field of Search ..... 219/707, 720, 219/506, 757, 705; 99/325

[56] References Cited

U.S. PATENT DOCUMENTS 4,162,381 7/1979 Buck ..... 219/707

4,295,028 10/1981 Tanabe ..... 219/720

4,350,860 9/1982 Ueda ..... 219/707

4,814,570 3/1989 Takizaki ..... 219/720

*Primary Examiner*—Philip H. Leung

[57] ABSTRACT

A microwave oven includes a microwave oven chamber in which food is cooked, an input unit for selecting modes of operation and other options, a control unit for driving the microwave oven by a driving signal input from the input unit, an oscillator for generating microwave in the chamber according to the driving signal from the control unit, a sensor unit for detecting a level of vapor generated from the food being cooked and outputting a detection voltage signal corresponding to the detection, and an indicator unit for continuously indicating the cooking state of the food according to the detection voltage signal as the cooking state progresses.

12 Claims, 5 Drawing Sheets

MICROWAVE OVEN WITH VAPOR SENSOR AND AUDIBLE COOKING STATE INDICATOR

BACKGROUND OF THE INVENTION

The present invention relates to a microwave oven, and more particularly, to microwave oven having an cooking state indicator which notifies the cooking state of the food to an user by using a buzzer or a speaker.

Generally, when the food is cooked by the microwave oven, the user must directly observe the food through a window of microwave oven to know the cooking state of the food. In this observation of the food, however, it is extremely difficult to recognize the cooking state of the food with the human eye through the windows. Thus, a notifying device that notifies the correct cooking state of the food to the user is needed in the microwave oven.

FIG. 1 is a view showing a conventional microwave oven. As shown in this figure, the conventional microwave oven comprises an input/output unit 6 for selecting the desired mode of cooking and indicating the cooking state of the food, a microwave oven chamber 1 in which the food is cooked, an oscillator 4 for generating microwave within the chamber 1 to cook, a sense unit 5 for sensing the vapor generated from the food, converting the sensed value of a vapor into the voltage signal, and then outputting the voltage signal, and a control unit 3 for driving the oscillator 4 and outputting the cooking state of the food to the input/output unit 6 according to the voltage signal inputted from the sensor unit 5. The input/output unit 6 includes an input unit 6*a* for operating the microwave oven and selecting the desired mode of operation and an indicator unit 6*b* for indicating the cooking state of the food 2.

In the above mentioned microwave oven, when the input unit 6*a* of the input/output unit 6 is operated to drive the microwave oven, the microwave is generating within the chamber 1 by the oscillator 4, being controlled by the control unit 3, so that the food within the chamber 1 is cooked. At the same time, a fan 8 connected to the control unit 3 applies the air into the chamber 1. As the food begins to cooked the level of vapor generated from the food. out the microwave oven. At that time, the sense unit 5 senses the vapor level and converts the sensed value of the vapor into the voltage. This voltage is inputted to the control unit 3 to notify the cooking state of the food 2 to the user by using the indicator unit 6*b* of the input/output unit 6.

FIGS. 2*a* and 2*b* are views showing the input/output unit 6. The input/output unit 6 includes the input unit 6*a* for driving the microwave oven and selecting the desired mode of operation and the indicator unit 6*b* for indicating the cooking state of the food 2. As shown in FIGS. 2*a* and 2*b*, the indicator unit 6*b* includes a plurality of lamps of bar-shape and mankind or animal-shape. As the food 2 is cooking, a higher level vapor to be sensed by the sensor unit 5 so that in a higher voltage is inputted to the control unit 3. As a results, the number of the lamps, barshape or mankind-shape, which is turned on increases.

In the conventional microwave oven however, to know the cooking state of the food, the user must always confirm the state of the indicator unit 6*b*. Thus, there is inconvenience in using the conventional microwave oven. In addition, when the user is working away from the microwave oven, it is impossible to quickly know the cooking state of the food 2.

SUMMARY OF THE INVENTION

It is an object of the present invention to provide a microwave oven in which the user is always able to know the correct cooking state of the food by using a buzzer or a speaker as a indicator even when the user is far away from the microwave oven.

In order to achieve this and other objects, the present invention comprises a microwave oven chamber in which the food is cooked, an input unit by which the order is inputted and the desired mode is selected, a control unit for driving the microwave oven by the signal inputted from the input unit, an oscillator for generating the microwave within the chamber by the signal from the control unit, a sensor unit for sensing the level of vapor generated from the food and outputting the voltage signal corresponding to the vapor level to the control unit, an indicate unit for indicating the cooking state of the food according to the voltage signal inputted to the control unit from the sensor unit.

A buzzer used as a indicator generates a different sounds (e.g., different tones of sound according to the frequency of the voltage inputted to the control unit from the sensor unit and a speaker makes a sound stored in the memory unit according to the voltage inputted to the control unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 29(*a* ) and 2(*b*) are views showing is a view the input/output unit of the conventional microwave oven;

DETAILED DESCRIPTION OF THE PREFERRED EMBODIMENTS

Figure 1:
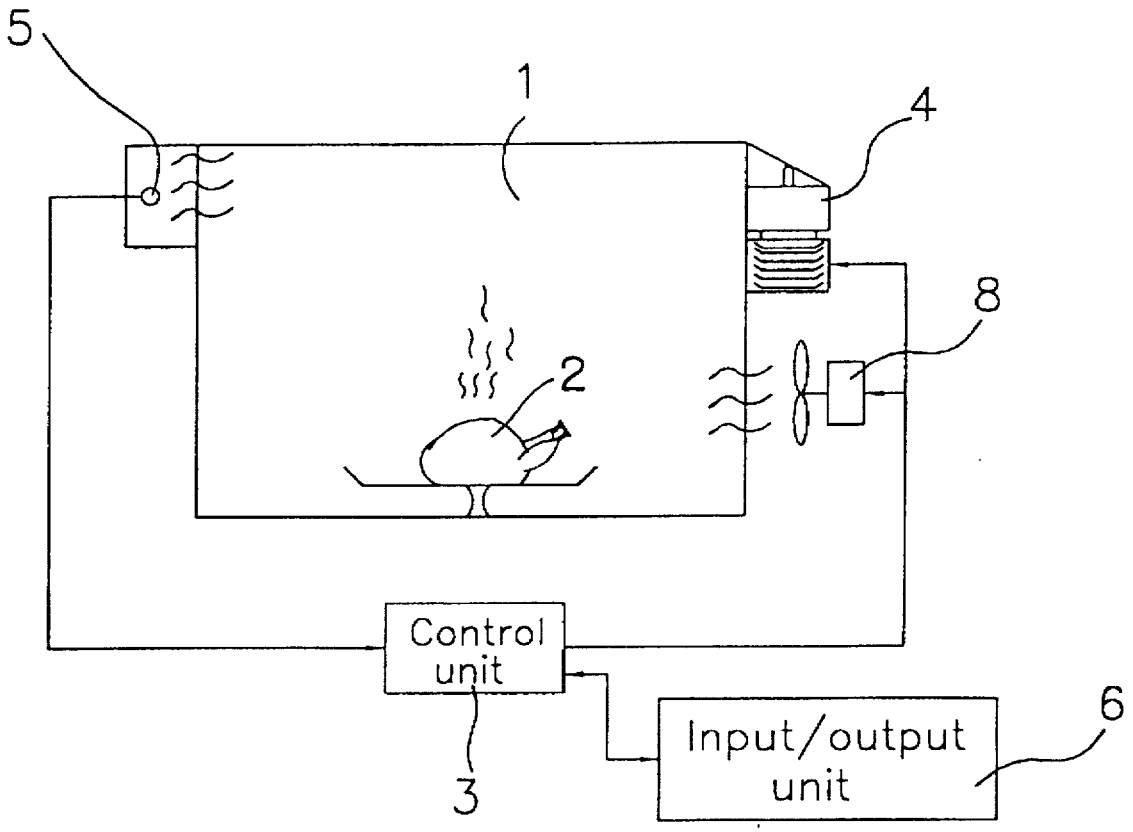
FIG. 1 PRIOR ART
FIG. 1 is a view showing the conventional microwave oven.
Figure 2A:
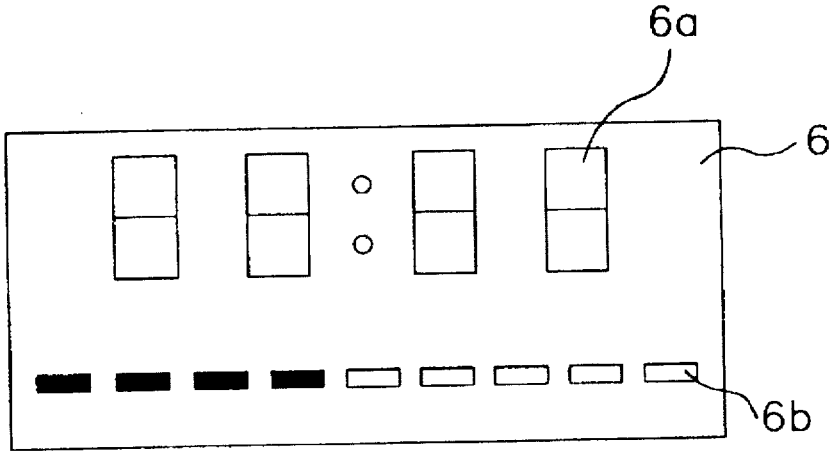
FIG.2a PRIOR ART
Figure 2B:
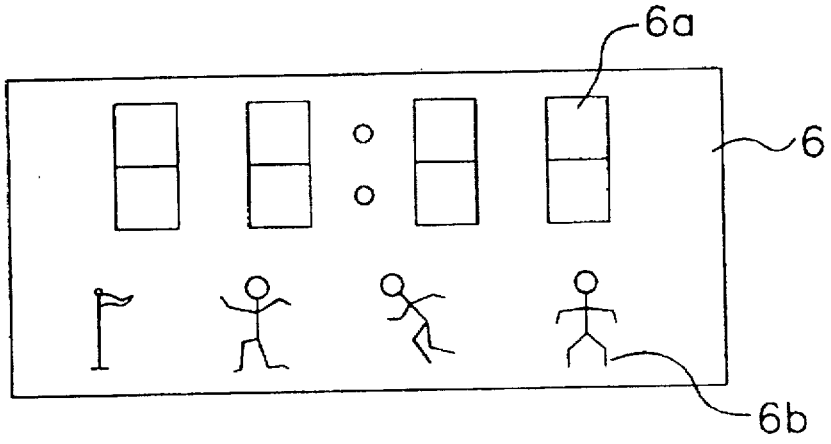
FIG.2b PRIOR ART
Figure 3:
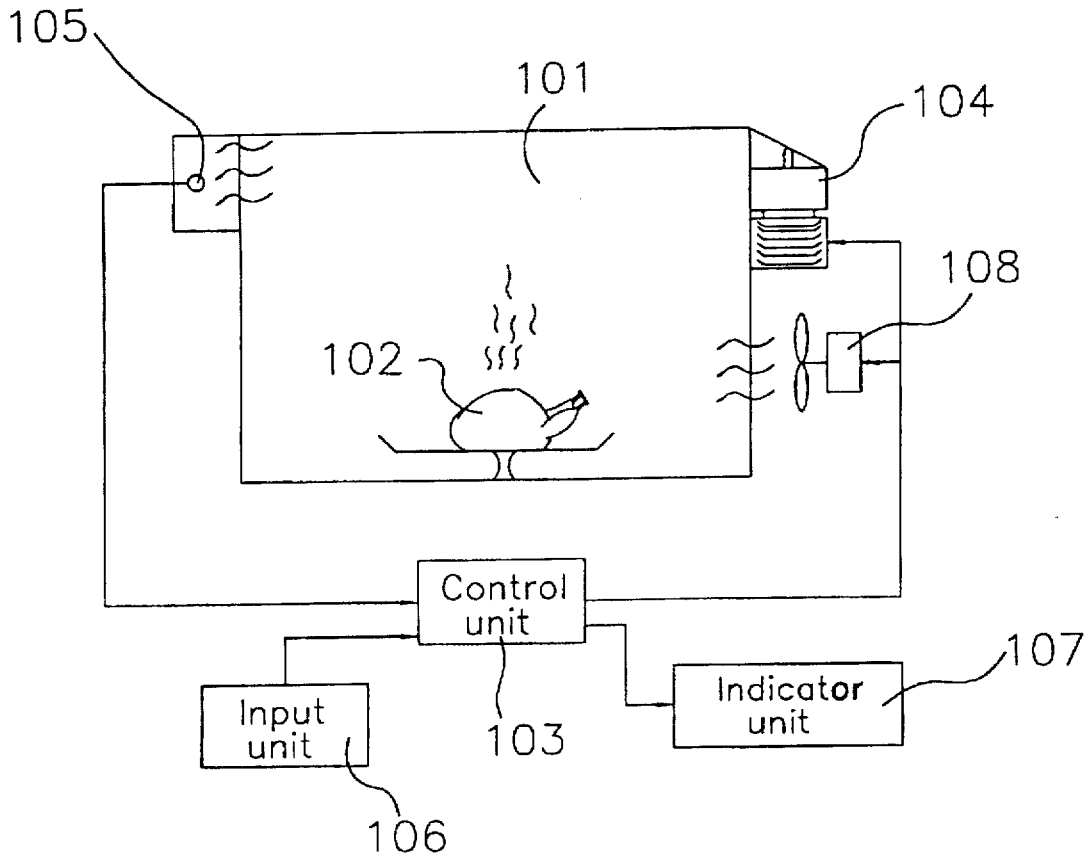
FIG. 3 is a view showing the microwave oven according to the embodiments of the present invention.

Referring to FIG. 3, the microwave oven according to the embodiments of the present invention comprises a microwave oven chamber 101 in which the food 102 is cooked, an input unit 106 for driving the oven and selecting an operation and other options, a control unit 103 for driving the microwave oven by the selected operation inputted to the input unit 106, an oscillator 104 for generating the microwave within a chamber 101 by the signal inputted from the control unit 103, a sensor unit 105 for sensing the level of vapor generated from the food which is being cooked and outputting the voltage signal corresponding to the sensed vapor level to the control unit 103, and an indicator unit 107 for indicating the cooking state of the food according to pulses inputted from the control unit 103. The pulses are generated to according to the voltage inputted the control unit 103 from the sensor unit 105. The control unit 103 is connected to a fan 108 which is mounted to the chamber 101 to supply air into the chamber 101.

When the driving order is inputted to the control unit 103 through the input unit 106, to operate the aforementioned microwave oven, the control unit 103 outputs the signal to drive a oscillator 104. By the driving of the oscillator 104, the microwave is generated within the chamber 101 to cook the food 102. At the same time, the fan 108 is operated by the signal from the control unit 103 to supply air into the chamber 101. At this time, the vapor is generated from the food being cooked. The sensor unit 105 senses the vapor level of the food 102, converts the sensed value into the voltage generated from, and then outputs this voltage to the control unit 103.

Figure 4:
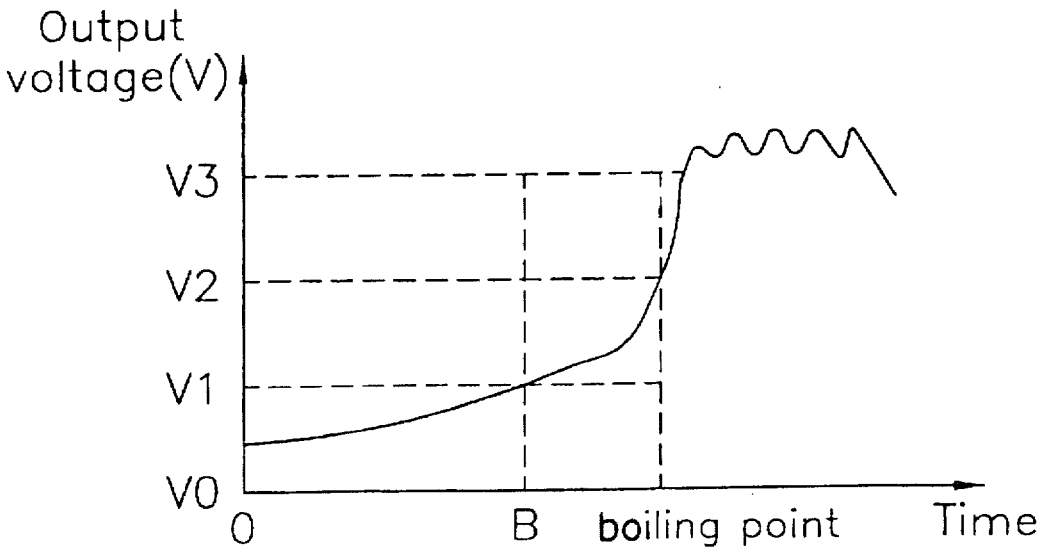
FIG. 4 is a view showing a waveform of the voltage to be outputting from a sensor unit of the microwave oven according to the present invention.

The control unit 103 outputs the pulses to the indicater unit 107 according to the voltage signal inputted by the sensor unit 103. With the lapse of cooking time, more vapor is generated from the food 102, so that the voltage inputted to the control unit 103 increases, as shown in, e.g. FIG. 4. The a voltage signal having a constant amplitude and an increasing frequency is applied to the indicator unit 107 with lapse of cooking time. Thus, when the prescribed voltage V1 is applied to the control unit 103, the control unit 103 outputs a pulse signal, corresponding to the voltage V1 to the indicator unit 107, so that the indicator unit 107 indicates the cooking state of the food to the user as pulses are generated intermittently.

Figure 5A:
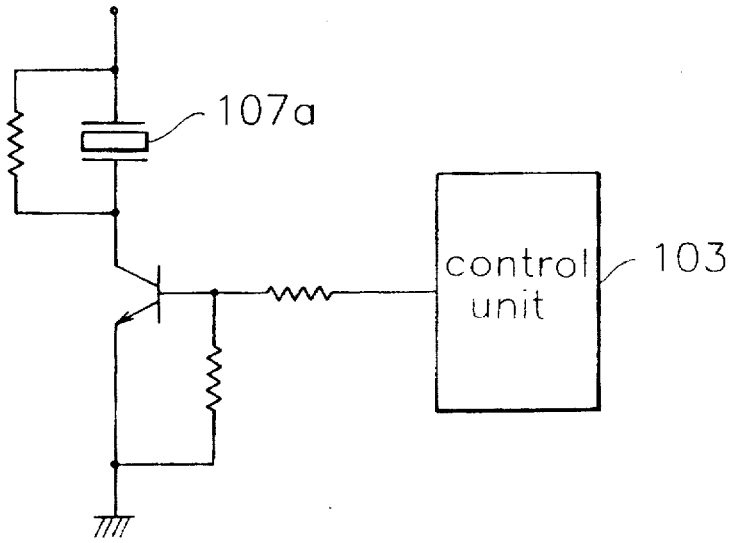
FIG. 5(*a*) to 5(*c*)are views for unit of the microwave oven according to a first embodiment of the present invention.

FIG. 5*a* is a view showing the indicator unit 107 of the microwave oven according to the first embodiment of the present invention. In this embodiment, the buzzer 107*a* is used in the indicator unit 107. Since the buzzer 107*a* is connected to the control unit 103 through a transistor Q1, as shown in FIG. 5*a*, when the voltage inputted to the control unit 103 by the sensor unit 105 is greater than the prescribed voltage V1, to indicate that the food is cooked some degree, the control unit 103 outputs the pulse signal to the transistor Q1 to turn it on. This activates the buzzer 107*a* to generate a sound corresponding to the pulse signal.

Figure 5B:
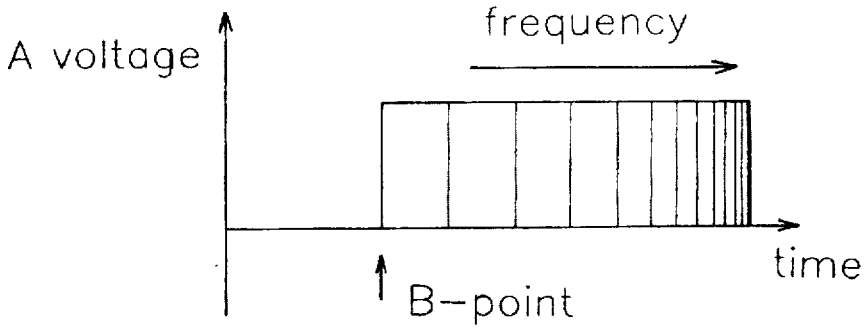

With the lapse of the cooking time, thereafter, the voltage output from the sensor unit 105 is increased. Thus, the frequency of the voltage signal applied to the transistor QI pulse also increases, as shown in FIG. 5*b*, so that the buzzer 107*a* makes a different sound varying according to the frequency of the voltage signal to audibly indicate the cooking state of the food 102 to the user. For example, a sound with gradually higher tone may be generated as cooking time passes.

Figure 5C:
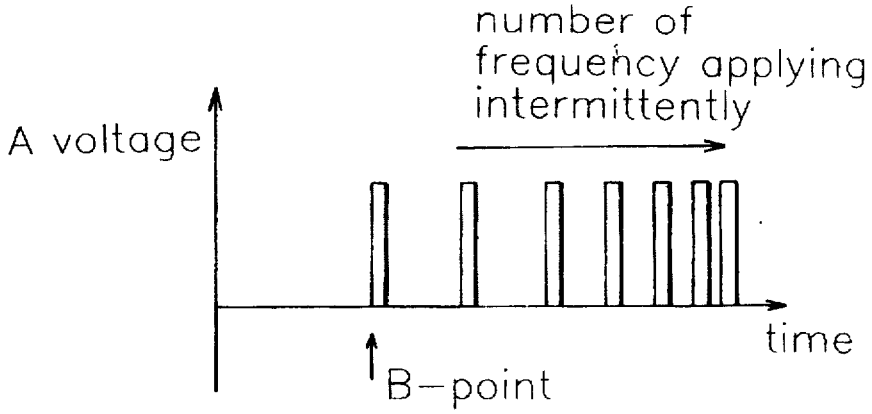

As shown in FIG. 5*c*, discrete pulses each having a uniform pulse width and with the period between the discrete pulses gradually decreasing according to lapse of the cooking time, are applied to the transistor Q1. Because the transistor Q1 is turned on only of when the pulse is applied the interval between the different sounds generated by the buzzer 107*a* decreases according to the lapse of the cooking time.

Figure 6:
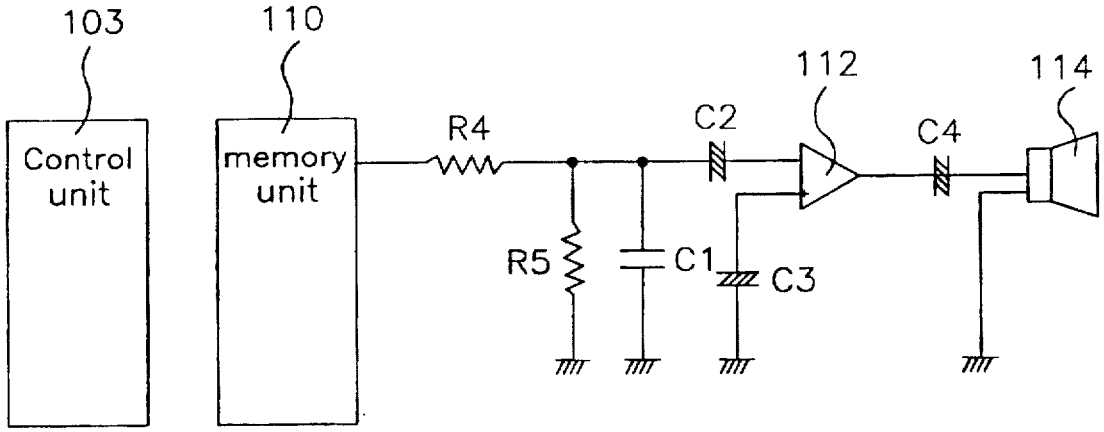
FIG. 6 is view showing an indicate unit of the microwave oven according to a second embodiment of the present invention.

FIG.6 is a view showing the indicator unit 107 of the microwave oven according to the second embodiment of a present invention. In this embodiment, the speaker 114 is included in indicator unit 107. With the lapse of the cooking time, the sensor unit 105 outputs a different voltage signal to the control unit 103. The control unit 103 searches the sound corresponding to the inputted voltage signal in the memory unit 110, which storages various sounds, then the speaker 114 generates selected sound through an amplifier 112 to audibly indicate the cooking state of the food 102 to the user.

In the 102 microwave oven according to the embodiments of the present invention, since the cooking state of food is notified to the user by using the a buzzer or speaker, the user who is away from the microwave oven is able to immediate know the cooking state of the food as the food is being cooked.

While the preferred form of the present invention has been described, it is to be understood that modifications will be apparent to those skilled in the art without departing from the spirit of the invention.

The scope of the invention, therefore, is to be determined solely by the following claims.

What is claimed is:

1. Microwave oven with a vapor sensor and an audible cooking state indicator, comprising:

a chamber for heating a substance therein;

oscillating means for generating microwave within said chamber sensing means for sensing a level of vapor generated from the substance during the heating of the substance and successively outputting a plurality of voltage signals according to the level of vapor sensed;

controlling means for driving said oscillating means and successively outputting a plurality of control signals in accordance with the voltage signals input from said sensing means;

switching means connected to said controlling means and being switched by the plurality of control signals from said controlling means; and a buzzer for continuously generating a plurality of sounds in accordance with the plurality of control signals input from said controlling means, wherein the plurality of sounds vary depending on frequencies of the voltage signals.

2. Microwave oven according to claim 1, wherein said buzzer is connected to said switching means and said controlling means, for generating the plurality of sounds as said switching means is turned on.

3. Microwave oven according to claim 1, wherein said switching means includes a transistor.

4. Microwave oven according to claim 1, wherein each of the control signals applied to said switching means includes a pulse, the frequency of said pulse depending on one of the voltage signals input to said controlling means.

5. Microwave oven according to claim 1, wherein each of the control signals applied to said switching means includes a pulse, said pulse being a discrete pulse signal having a uniform pulse width, the period between said discrete pulses decreasing in accordance with the lapse of heating time.

6. Microwave oven according to claim 1, further comprising:

fan mounted in said chamber so as to supply air into said chamber, said fan being connected to said controlling means.

7. Microwave oven according to claim 1, wherein the plurality of sounds vary in tone and are continuously generated throughout the heating of the substance so as to indicate continuously a cooking state of the substance being heated.

8. A method of operating a microwave oven with a vapor sensor and an audible cooking state indicator, comprising the steps of:

heating a substance in a chamber using microwave;

sensing a level of vapor generated from the substance during the heating of the substance;

successfully outputting a plurality of voltage signals according to the level of vapor sensed;

successfully outputting a plurality of control signals in accordance with the voltage signals;

continuously generating a plurality of sounds using a buzzer in accordance with the plurality of control signals, wherein the plurality of sounds vary depending on frequencies of the voltage signals.

9. The method according to claim 8, wherein the step of successfully outputting the plurality of control signals includes the step of:

generating a plurality of pulses, the frequency of each pulse depending on one of the voltage signals.

10. The method according to claim 8, wherein each of the control signals includes a pulse, said pulse being a discrete pulse signal having a uniform pulse width, the period between said discrete pulses decreasing in accordance with the lapse of heating time.

11. The method according to claim 8, further comprising the step of:

supplying air into the chamber using a fan.

12. The method according to claim 8, wherein the continuously generating step includes the step of:

continuously generating the plurality of sounds which vary in tone throughout the heating of the substance, so as to continuously indicate a cooking state of the substance being heated.

* * * * *